United States Patent [19]

Gombar

[11] Patent Number: 4,869,428

[45] Date of Patent: Sep. 26, 1989

[54] HAND ACTUATED CONNECT/DISCONNECT SPRAY ARM ARRANGEMENT FOR A DISHWASHER

[75] Inventor: Eugene Gombar, Apollo Beach, Fla.

[73] Assignee: Jackson Products Company, Tampa, Fla.

[21] Appl. No.: 229,478

[22] Filed: Aug. 8, 1988

[51] Int. Cl.[4] ..... B05B 3/06

[52] U.S. Cl. ..... 239/261; 134/179; 285/38; 285/190; 285/360

[58] Field of Search ..... 134/176, 179, 180, 181; 239/261, 264; 285/38, 190, 360, 361, 376, 396, 401, 402

[56] References Cited

U.S. PATENT DOCUMENTS

| | | | |
|---|---|---|---|
| 939,036 | 11/1909 | Koper | 285/376 X |
| 2,165,163 | 7/1939 | Waters | 285/361 X |
| 2,286,263 | 6/1942 | Comins | 285/38 X |
| 3,866,837 | 2/1975 | Jenkins | 239/261 |
| 4,014,467 | 3/1977 | Ferguson | 134/179 X |
| 4,175,575 | 11/1979 | Cushing | 134/180 X |

FOREIGN PATENT DOCUMENTS

| | | | |
|---|---|---|---|
| 102004 | 9/1937 | Australia | 285/360 |
| 2428045 | 1/1975 | Fed. Rep. of Germany | 134/176 |

*Primary Examiner*—Philip R. Coe

*Attorney, Agent, or Firm*—Body, Vickers & Daniels

[57] ABSTRACT

A hand actuated, connect/disconnect arrangement is provided for the spray arms of a dishwasher. The spray arms are rotably mounted to a spindle having a cylindrical stem portion and a larger cylindrical spacer portion adapted to fit within the bore of a hub member in turn connected to the water supply. A tab segment extending inwardly in the bore and an ear section extending outwardly from the spindle are rotated into overlying contact with one another in a connected position whereby a washer is compressed to seal the hub and stem while preventing the ear-tab contact surface from inadvertently rotating to a disconnect position.

24 Claims, 5 Drawing Sheets

HAND ACTUATED CONNECT/DISCONNECT SPRAY ARM ARRANGEMENT FOR A DISHWASHER

This invention relates generally to the dishwasher appliance art and more particularly to a quick connect-/disconnect system for removing the spray arm of a dishwasher.

The invention is particularly applicable to dishwashers of the commercial type and will be described with particular reference thereto. However, it will be appreciated that the invention can be easily applied to residential dishwashers and, in a broader conceptual sense, to any spray arrangement where a rotating spray arm or device must be periodically connected and disconnected from a spray supply line.

BACKGROUND OF THE INVENTION

Generally speaking, all dishwashers have at least one spray arm, rotably mounted to a fixed spindle which in turn is connected to the water supply line. Water exiting under pressure from the openings in the spray arm causes the arm to rotate about the spindle as it washes and rinses the utensils in the dishwasher tub. All dishwashers have provisions for removing the spray arm for periodic cleaning. Residential dishwashers or dishwashers sold to the consuming public may employ a simple plastic wing nut threaded to the end of a spindle for hand removal and installation of the spray arm.

Commercial ware washers are operated in a severe environment and are built to more exacting standards than residential washers. The mounting of the spray arm to the spindle is typically accomplished by a closely controlled bearing/race assembly which permits accurately controlled, free-wheeling blade rotation with minimal pressure drop. It can be appreciated that with sanitizing, detergent and rinse chemicals being dispensed through the spray arms, lime and other corrosive deposits will naturally occur and require periodic cleaning, approximately weekly, of the spray arm arrangement. In addition, failure to properly clean the pump strainer in the dish washing system, may permit food particles to enter the dishwasher arm, possibly clogging some of the jets and adversely affecting rotation and operation of the dishwasher.

In one conventional spray arm arrangement, the spray arms are inserted into a spray arm hub and a bearing arrangement between the spray arm hub and a flange on the spindle is used to mount the hub in a free-wheeling manner on the spindle. A wash cap having a bearing arrangement in contact with the top of the spray arm hub is screwed on to the threaded end of the spindle to clamp the bearing assembly in place. The wash cap in turn is locked to the threaded spindle end by a set screw. When the spray arm is to be removed for cleaning, tools are required and the bearing assembly must also be dismantled. This can be especially difficult because the removal is done within the confines of the dishwasher tub.

In the unrelated connector art, a wide variety of hose connections are known. Glad hand hose connections, common on tractor trailer vehicles and railroad cars, use a rotating bayonet system for air brake lines. While such hose connections are subject to sudden forces and to vibration, the vibrations and eccentric loadings on the dishwasher spindle from the spray arms present different design considerations when considering a hand applied connect/disconnect arrangement.

DESCRIPTION OF THE INVENTION

Accordingly, it is a principle object of the present invention to provide a hand applied connect/disconnect system for a dishwasher spray arm assembly which not only establishes a water seal but also provides an anti-rotational lock to assure a secure assembly.

When the term "hand applied" is used herein with reference to a connect/disconnect arrangement, it means a connect/disconnect which can be applied and removed from the dishwasher by the operator not having to use any tools, such as wrenches or screwdrivers.

This object along with other features of the invention is achieved by hand applied spray arm assembly for a dishwasher appliance and the like which includes a hub member sealingly secured to the tub of the dishwasher and having a configured bore axially extending through the hub. A spindle is provided for removable insertion into the hub. A conventional mounting arrangement is used to secure the spray arm to the spindle which permits the spray arm to discharge water from a water supply line transmitting a pressurized stream of water through the hub, the spindle and into the arm. A resilient washer is provided within the bore of the hub for providing a water seal between the stem and the hub. The hub has at least one especially configured tab extending radially inwardly into the bore. The spindle has at least one especially configured ear extending radially outwardly. The tab and the ear have mating contact surfaces for contacting each other when the base of the spindle is inserted into and rotated within the hub whereby the washer is compressed to seal the hub and the spindle. The tab and the ear contact surfaces are especially configured to prevent the contact surfaces from moving relative to one another when the dishwasher is in operation to effect a stable connection while providing the water seal.

In accordance with a more specific feature of the invention, the ear has a ramp end surface adjacent one end of the contact surface and a stop end surface adjacent the opposite end of the contact surface. The anti-rotation configuration includes the contact surface of a tab having a depression formed therein adjacent one end thereof and a projection in the form of the depression extending from the contact surface of the ear adjacent its stop end surface so that when the depression is engaged with the recession in the connected position of the assembly, any tendency of the connection to loosen requires a further compression of the washer as the projection must vertically move out of the recess. Obviously, the washer, especially when subjected to water pressure from the supply, resists any further compression. Thus, the connect/disconnect arrangement effectively resists loosening attributed to the vibrations experienced by the dishwasher during operation.

In accordance with more specific secondary features of the invention, the stop end surface of the ear extends beyond the elevation of the contact surface of the tab and thus functions as a positive stop preventing excessive rotation of the spindle relative to the hub and insuring engagement of the depression-recession or detent mechanism described above. The ramp surface of the ear is inclined relative to the contact surface of the ear to assure engagement of the contact surfaces of the ear and tab as the spindle is rotated in the hub into its locked connection. The ramp surfaces additionally provide a mechanism for the operator to compress the washer without having to apply excessive axial pressure to the spindle. Preferably a pair of dismetrically opposed ears and a pair of diametrically opposed tabs extending over a preferred arcuate distance is provided so that the spindle with the spray arm can be easily dropped into the hub member. The stop end surfaces on the ears insure fail safe application of the connection in that the connection can be only rotated in one direction (clockwise) to lock and only one direction (counterclockwise) to unlock.

In accordance with still another aspect of the invention the spindle has a radially outwardly extending flange, axially spaced from the spindle ears. The flanges are configured to provide a pair of diametrically opposed, outwardly extending lugs which are configured to be easily grasped by the thumb and center finger of the person applying the spray arm to the dishwasher and the flanges are orientated to be spaced 90° from the spindle ears to permit the operator to position the spindle in the hub and rotate it into locking engagement in almost one continuous motion.

In accordance with still another feature of the invention, the washer has a flat annular forward surface, a larger outside diameter annular rearward surface and an edge surface therebetween. The edge surface is defined by a cylindrical surface adjacent the forward surface and a frusto-conical surface adjacent the rearward surface, and the frusto-conical surface defines a V-shaped lip at a specific angle. The bore of the hub member had an annular V-shaped recess formed therein and one leg of the recess extends to a diameter equal to the outside diameter of the rearward surface of the washer and has a length extending at least to the opening or ID of the washer. The other leg of the recess extends to a diameter greater than and not less than the outside diameter of the forward surface of the washer but at a larger angle than that of the washer lip. The V-shaped lip-recess arrangement provides not only a structure for retaining the washer in its proper position during removal and insertion of the spindle into the hub member, but the V-shaped recess is filled with distended washer material when the washer is compressed to improve the life and sealing characteristics of the washer.

In accordance with still another feature of the invention, the connect/disconnect system disclosed provides a stable columnar support for the spindle which not only resists spray arm vibration but also eccentric shock loadings, in that attitudinal displacement of the spindle is resisted by two axially spaced support points within the connect/disconnect mechanism. More specifically, the relative dimensioning of the washer arrangement disclosed permits the stem of the spindle to extend past the washer in almost diametrical contact with the bore of the hub member so that any predetermined angular or attitudinal movement of the spindle results in line contact of the stem portion of the spindle within the bore of the hub member. Initially, the washer and contact surfaces of the tab-ear and the distension of the washer under compression provides two axially spaced contacts attitudinally supporting the spindle. The distension of the washer under compression provides a dampener deadening vibration which would otherwise be transmitted through the spindle to the hub member. Should the spray arm for whatever reason (i.e., contact with a utensil in the tub) be subjected to a large eccentric force, the washer will resiliently deform to permit metal contact between the spindle stem and the hub bore thus maintaining a stable axially spaced columnar support arrangement for the connect/disconnect assembly.

Accordingly, it is an object of the invention to provide a hand actuated, water sealed, connect/disconnect arrangement for a dishwasher spray arm.

It is another object of the invention to provide a connect/disconnect arrangement for a dishwasher spray arm which, in a connect position, contains means for positively preventing unlocking of the connection.

It is yet another object of the invention to provide a connect/disconnect arrangement for a dishwasher spray arm which contains improved water sealing characteristics even though the device is hand actuated only.

It is yet another feature of the invention to provide a connect/disconnect arrangement for a dishwasher spray arm which is columnarly stable to resist eccentric forces exerted on the connect/disconnect arrangement from the dishwasher spray arm.

Still another object of the invention is to provide a connect/disconnect arrangement for a dishwasher spray arm which can be easily retrofitted to existing dishwasher designs.

Still yet another object of the invention is to provide a connect/disconnect arrangement for a dishwasher spray arm which is user friendly and easy to operate by hand.

Still yet another object of the invention is to provide a functionally simple and reliable connect/disconnect arrangement for wash and rinse arm assemblies in commercial ware washers.

These and other objects of the invention will become readily apparent to those skilled in the art upon reading and understanding the detailed specifications set forth below.

DESCRIPTION OF THE DRAWINGS

The invention may take physical form in certain parts and arrangements of parts, a preferred embodiment of which will be described and detailed and illustrated in the accompanying drawings which form a part hereof an wherein.

DESCRIPTION OF THE PREFERRED EMBODIMENT

Figure 1:
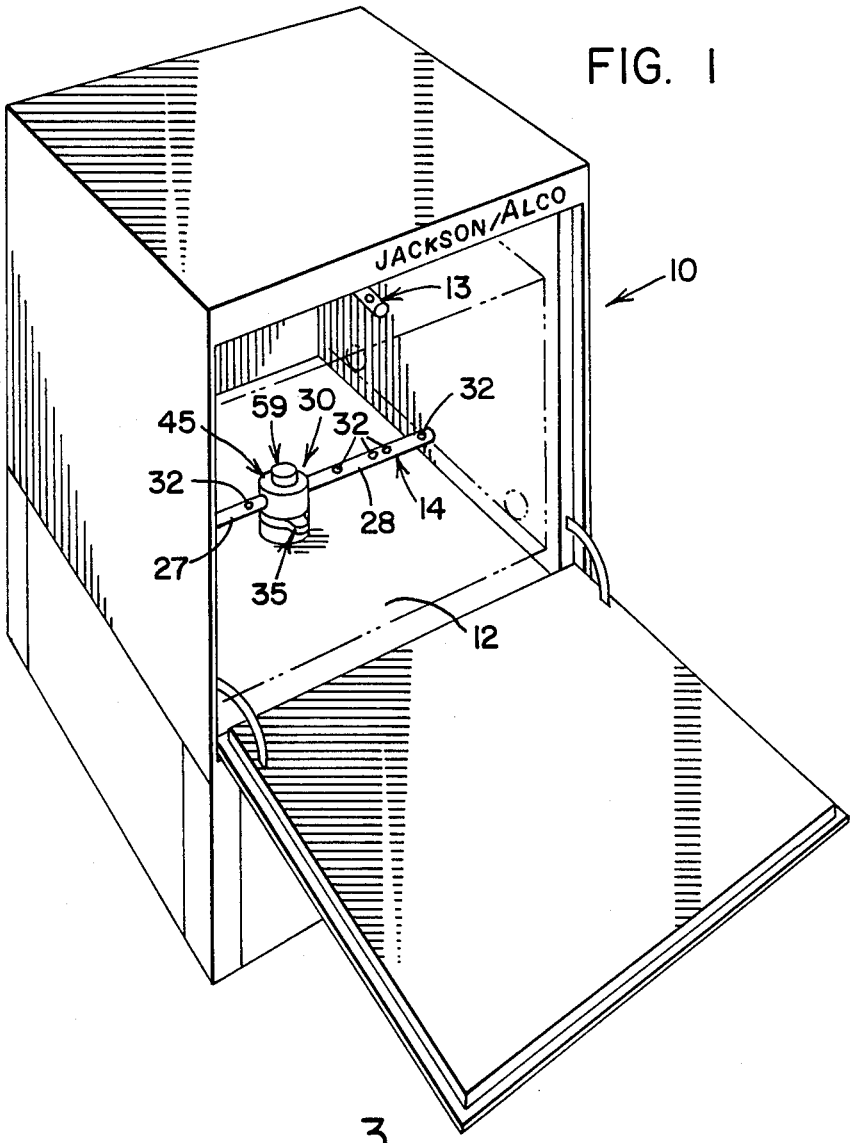
FIG 1 is a perspective view of a dishwasher showing a spray arm incorporating the connect/disconnect arrangement of the subject invention.
Figure 9:
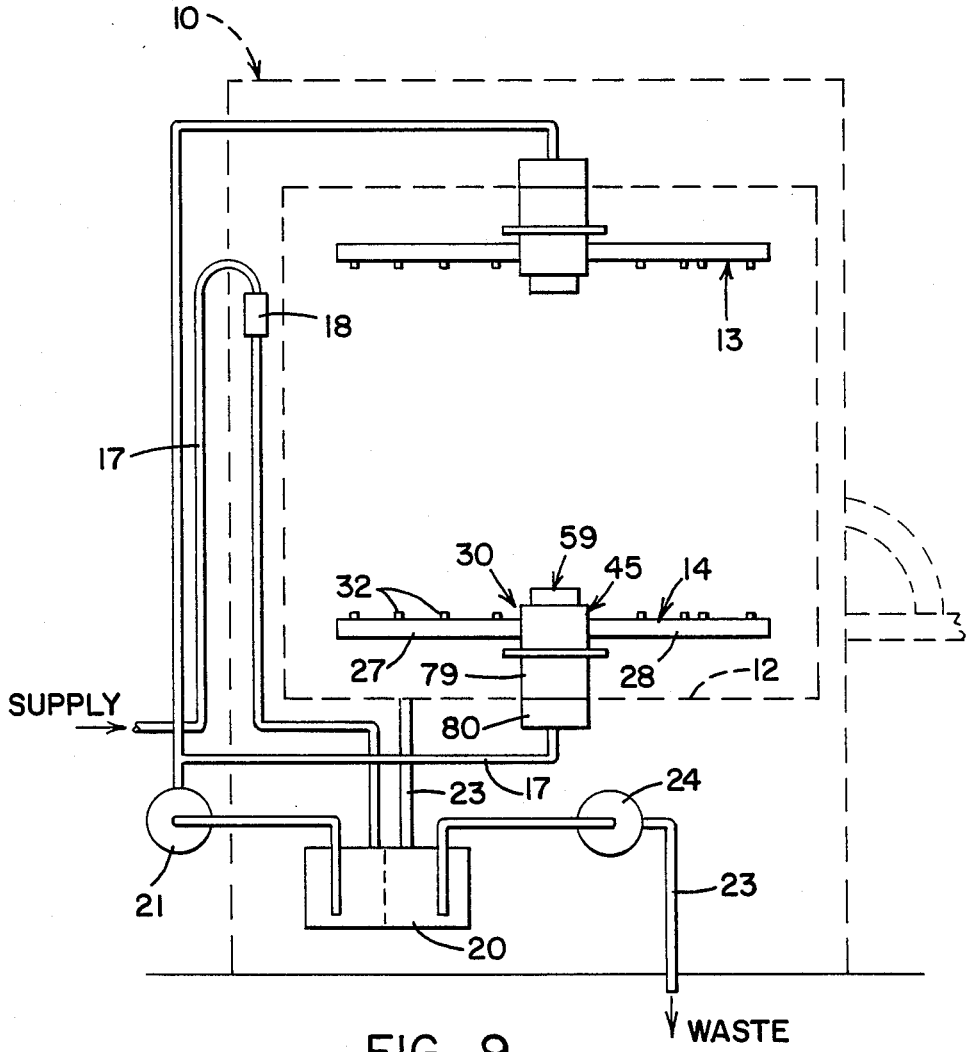
FIG. 9 is a conceptualized schematic view of a conventional pump arrangement used in a commercial dishwasher employing the subject invention.

Referring now to the drawings wherein the showings are for the purpose of illustrating the preferred embodiment of the invention only and not for the purpose of limiting the same, there is shown in FIGS. 1 and 9 a dishwasher 10 containing a standard porcelain or stainless steel, sealable tub 12 within which extends an upper wash/rinse spray arm 13 and a lower wash/rinse spray arm 14. Dishwasher 10 shown in the preferred embodiment uses two spray arm assemblies 13, 14 and only lower spray arm assembly 14 will be described in detail herein with the understanding that the same description and explanation equally applies to upper spray arm assembly 13.

A somewhat conventional plumbing arrangement for dishwasher 10 is shown in FIG. 9 wherein a water supply line 17 filtered at 18 supplies heated water to a tank 20. Metering apparatus (not shown) mixes controlled amounts of detergent and/or sanitizing chemicals such as chlorine, etc. in tank 20 regulated, of course, in accordance with the wash/rinse cycles that the dishwasher is undergoing. An external pump 21 injects the treated water at controlled pressure to upper and lower spray arm assemblies 13, 14. An exhaust line 23 is provided for emptying the water from tub 12 to tank 20 where it is strained by a strainer (not shown) and pumped by pump 24 to a waste drain. Alternatively, the water could be recycled in tank 20. Alternatively, tank 20 could simply be viewed as a container(s) or tank(s) containing either sanitizing chemicals or detergents and the exhaust line directly empties into the waste drain. A conventional, nozzle aspiration concept actuated by the water flow from supply line 17 is then used to draw a metered amount of chemicals from tank 20 to spray arm assemblies 13, 14. The plumbing arrangement is not a part of the subject invention and several variations are described as examples of supplying water to upper and lower spray arm assemblies 13, 14. What is important is that the water supply to spray arm assemblies 13, 14 be done so at a fixed pressure. For the dishwasher disclosed, supply line 17 (½ inch minimum) must supply water at 20 psi. The water should be at a minimum temperature of 120° F. (140° F. preferred) with a flow rate of 43.7 gallons per hour.

Figure 2:
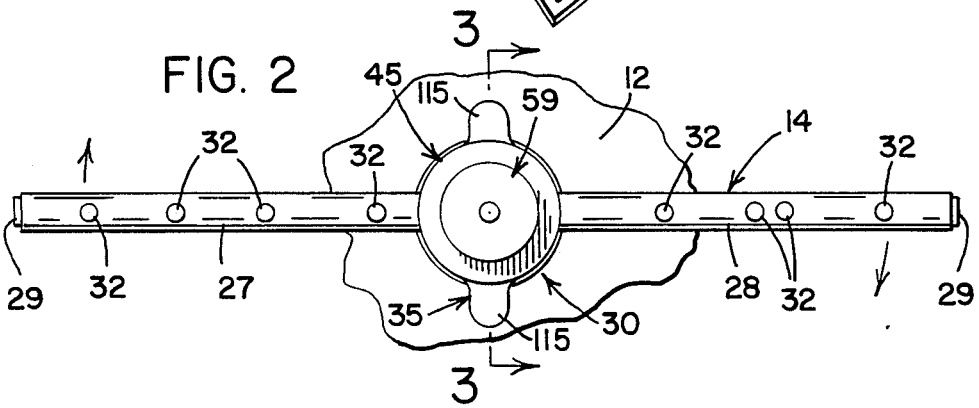
FIG. 2 is a plan elevation view of the dishwasher spray arm employing the connect/disconnect arrangement of the subject invention.

Referring now to FIG. 2, spray arm assembly 14 includes left and right hand arms 27, 28, each of which is plugged at its outer end by a removable threaded plug 29 and mounted (as by welding or threaded engagement) at its inner end into a bearing spray arm hub assembly 30. Plugs 29 are removable so that a brush or like implement can be inserted into each spray arm 27, 28 to clean food, lime and other clogging deposits therefrom. Nozzles 32 formed or mounted on each spray arm 27, 28 have different angular orientations relative to the longitudinal centerline of each spray arm 27, 28, varying spacings therebetween and different sizes to produce a desired spray pattern and generate an appropriate force which causes spray arms 27, 28 and bearing arm hub assembly 30 to rotate, under water pressure, in the direction of the arrows shown in FIG. 2. Spray arm hub assembly 30 is rotably mounted in a free-wheeling manner to a spindle 35 within tub 12.

Figure 3:
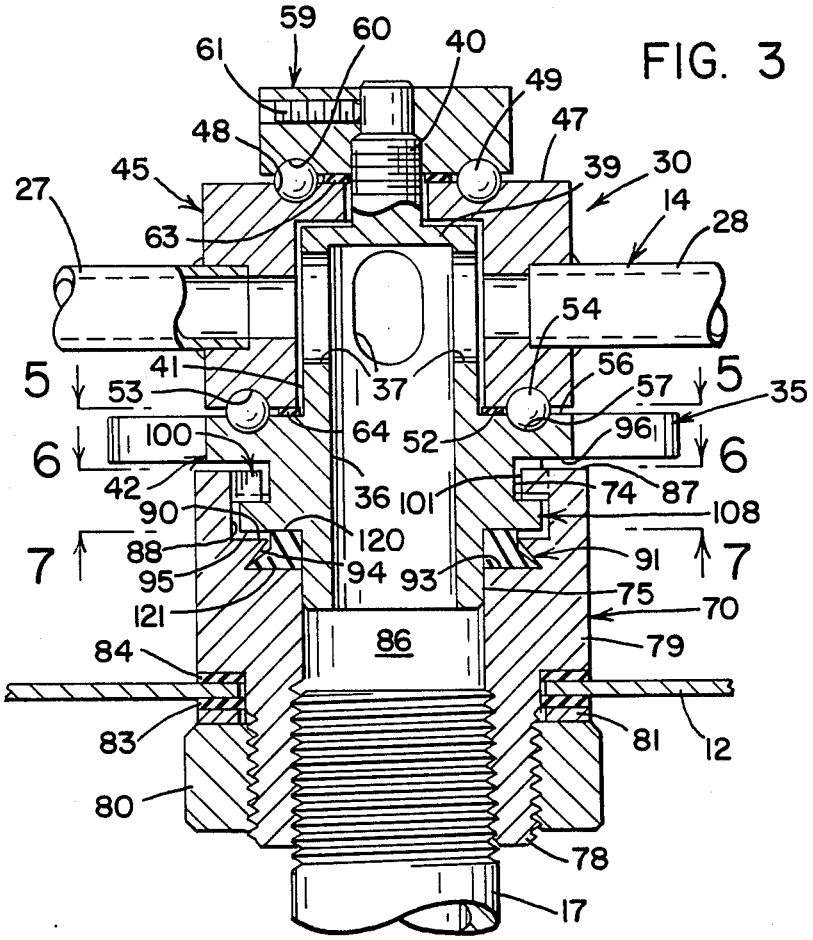
FIG. 3 is a cross-section elevation view of the connect/disconnect arrangement taken along lines 3—3 of FIG. 2.

One type of bearing hub assembly 30 is illustrated in FIG. 3. As noted, spray arm hub assembly 30 is affixed in a free-wheeling manner to spindle 35 which has a blind central bore 36 terminating at a "X" crossway passageway 37 adjacent a capped end 39 of spindle 35. Capped end 39 includes a protruding threaded rod portion 40. Extending from capped end 39 is a cylindrical capped end portion 41 which terminates at a cylindrical flange portion 42 of spindle 35. Cylindrical flange portion 42 extends radially outwardly to a diameter greater than cylindrical capped end portion 41. As noted, spray arms 27, 28 are permanently affixed to a spray arm hub 45. Spray arm hub 45 has a top annular surface 47 into which a circular raceway 48 is formed for receiving a plurality of cap ball bearings 49. Spray arm hub 45 also has a bottom annular surface 52 likewise containing a circular raceway 53 for carrying a plurality of flange ball bearings 54. Cylindrical flange portion 42 of spindle 35 has an annular forward facing surface 56 likewise carrying a circular raceway 57 identical to the circular raceway 53 on bottom annular surface 52. A wash cap 59 having a circular raceway 60 identical to raceway 48 on top annular surface 47 is screwed onto threaded rod portion 40 and when cap ball bearings 49 and flange ball bearings 54 are properly contained in their respective raceways 48, 60 and 53, 57 respectively, a set screw (not shown) in the threaded cross opening 61 locks spray arm hub assembly 30 together as an assembly secured to spindle 35. Plastic spindle rings 63, 64 between the interior of spray arm hub 45 and spindle cap end portion 41 and above and below crossway passage 37 prevent leakage of water between spindle 35 and spray arm hub 45 while permitting rotation of spray arm hub 45 relative to stationary spindle 35. Not shown for simplicity purposes in FIG. 3 are washers or bearing retainers to be used in conjunction with cap and flange ball bearings 49, 54. As thus far described, the spray arm arrangement is conventional. It will be noted that the spray arm hub assembly 30 rigidly mounts spray arms 27, 28 to spindle 35 in a manner which permits little, if any, wobble or attitudinal movement of spray arms 27, 29 relative to the longitudinal or axial centerline of spindle 35. This mounting, conventional in commercial ware washers, should be contrasted to the relatively loose arrangements employed in residential dish washing machines. The difficulty in removing spray arms 27, 28 from with tub 12 in a conventional application using spray arm hub assembly 30 can be readily visualized.

Figure 8:
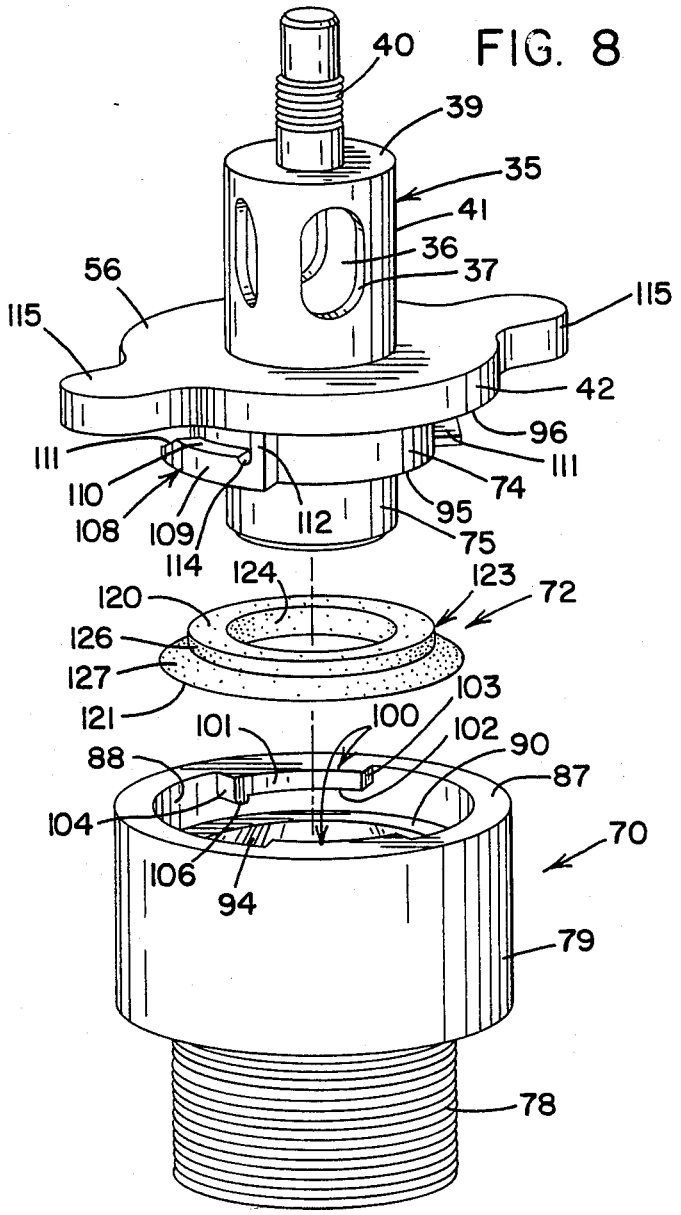
FIG. 8 is an exploded perspective view of the parts of the connect/disconnect assembly.

Referring now to FIG. 8, the parts which form a connect/disconnect assembly of the present invention include spindle 35, a hub member 70 and a washer 72. As described previously, spindle 35 includes a cylindrical cap end portion 41 from which extends a cylindrical flange portion 42. Extending from flange portion 42 is a generally cylindrical spacer portion 74 having an outside diameter lesser than that of flange portion 42. Depending from cylindrical spacer portion 74 is a generally cylindrical stem portion 75 which is adapted as shown to extend into hub member 70. Hub member 70 has a threaded stem portion 78 which is adapted to extend through and to the outside of tub 12 and a hub portion 79 which is within tub 12.

Figure 4:
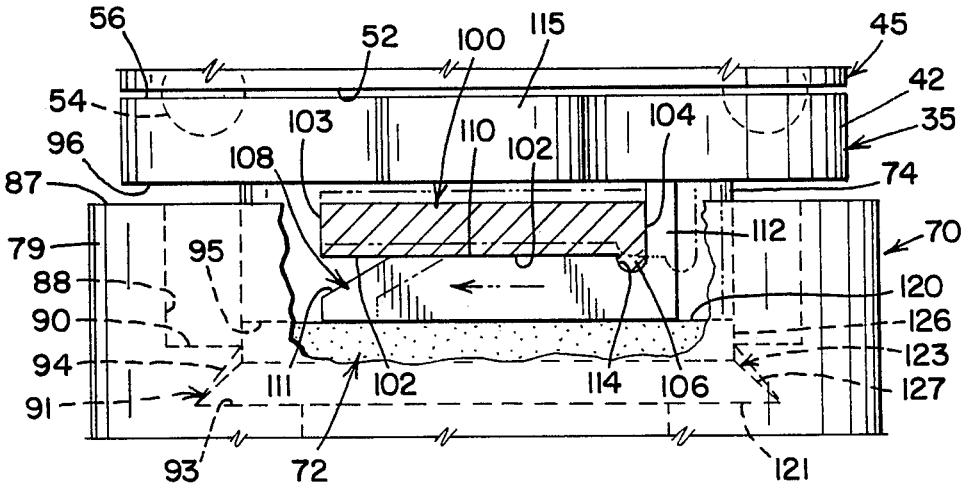
FIG. 4 is a side elevation view with parts partly broken away showing various components of the connect/disconnect arrangement.
Figure 5:
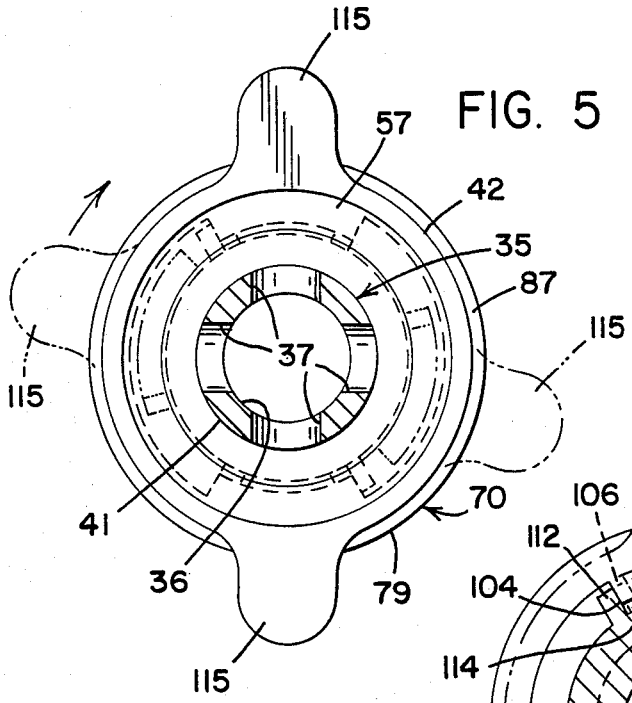
FIGS. 5, 6 and 7 are cross-sectional plan elevational views of the connect/disconnect arrangement taken along lines 5—5, 6—6 and 7—7, respectively, of FIG. 3.
Figure 6:
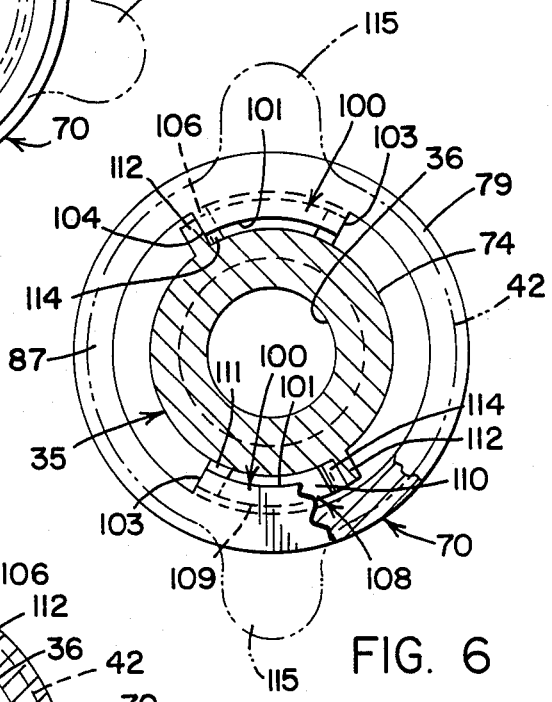
Figure 7:
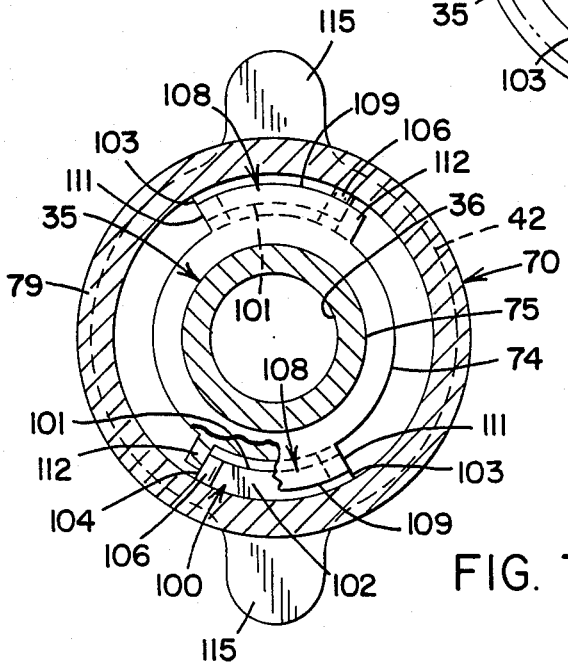

Referring now to FIGS. 3, 4 and 8 a fastening nut 80 and a washer 81 threaded onto hub stem portion 78 seals hub member 70 to tub 12 by compressing appropriate gaskets 83, 84. Hub member 70 has an especially configured hub bore 86 axially extending therethrough. Hub bore 86 in stem portion 78 is generally cylindrical and threaded to receive water supply line 17. Hub bore 86 is especially configured in hub portion 79 to receive spindle 35 in a connect/disconnect manner. More specifically, hub member 70 has an annular hub end surface 87 from which a generally cylindrical, hub bore section 88 extends a fixed axial distance from hub end surface 87. Hub bore section 88 terminates at an annular hub washer forward seat surface 90 which extends radially inwardly from the cylindrical bore surface and, as noted, defines the end of hub bore section 88. Extending from hub washer forward seat surface 90 and axially towards stem portion 78 is a frusto-conical or V-shaped bore section 91 which terminates at an annular hub washer rearward seat surface 93 which extends radially inwardly a distance such that the inside diameter of annular hub washer rearward seat surface 93 is equal to the diameter of bore 86 in hub stem portion 78. More specifically, V-shaped bore recess is defined by an acute angle of approximately 49° which frusto-conical bore surface 94 forms with annular hub washer rearward seat surface 93.

With respect to spindle 35, cylindrical stem portion 75 commencing at one end of spindle 35 extends a fixed axial distance towards cap end 39 and terminates in an annular spindle forward washer seat surface 95 which extends radially outwardly from the cylindrical surface defining stem portion 75 and commences the beginning of cylindrical spacer portion 74. Spacer portion 74 axially extends a fixed distance towards cap end 39 and terminates at an annular rearward flange surface 96. Rearward flange surface 96 defines the beginning of cylindrical flange portion 42 which terminates at top annular forward facing surface 56 as previously described and from which extends cylindrical cap end portion 41.

Co-planar with annular hub end surface 87 of hub member 70 and extending about hub bore section 88 for a fixed arcuate distance of about 60° is a tab segment 100, there actually being two tab segments diametrically opposed to one another. The configuration of only one tab segment will be explained. Tab segment 100 extends radially inwardly from the cylindrical surface of hub bore section 88 until tab segment 100 terminates in a generally arcuate edge surface 101 which extends axially a fixed distance towards stem portion 78 and terminates in a contact surface 102. Contact surface 102 extends radially outwardly from arcuate edge surface 101 to the cylindrical surface of hub bore section 88 and is generally perpendicular to the cylindrical surface of hub bore section 88. An axially extending leading end wall 103 and, similarly, an axially extending trailing end wall 104 define the ends of contact surface 102. End walls 103, 104 are generally perpendicular to contact surface 102. A portion of contact surface 102 adjacent trailing end wall 104 is formed as a dimple or a projection 106 which extends axially towards stem portion 78 and away from contact surface 102. The cross sectional configuration of projection 106 is semi-circular and in the preferred embodiment the projection extends from arcuate edge surface 101 to the cylindrical surface of hub bore section 88.

Co-planar with arcuate spindle forward washer seat surface 95 is an ear projection or section 108 which protrudes from and extends about generally cylindrical spacer portion 74 of spindle 35 an arcuate distance of approximately 60°, there being two ear sections 108 diametrically opposed to one another. The description of one ear section 108 will be equally applicable to the other ear section. In a manner similar to that described for tab segment 100, ear section 108 extends radially outwardly from the cylindrical surface of spacer portion 74 until ear section 108 terminates in a generally arcuate edge surface 109 which extends axially a fixed distance in the direction of cap end 39. Arcuate edge surface 109 terminates at a contact surface 110 which extends radially inwardly from arcuate edge surface 109 and generally perpendicular to and until contact with the cylindrical surface of spacer portion 74. Contact surface 110 has a leading end defined by leading end wall 111 which is shown as inclined, angled or ramped with respect to contact surface 110. The opposite end of contact surface 110 is defined by a trailing or stop end wall 112 which is generally perpendicular to contact surface 110 and extends axially beyond contact surface 110 until stop end wall 112 contacts annular, rearward flange surface 76 of spindle 35. Contact surface 110 adjacent stop end wall 112 is configured to form a recess 114 conforming to the shape of projection 106. In the preferred embodiment, recess 114 has a generally semicircular cross-section configuration to define a groove which extends from edge surface 109 to the cylindrical surface of spacer portion 74.

A pair of diametrically opposed lug projection 115 extend radially outwardly from the cylindrical surface of flange portion 42. Lug projections 115 have a configuration which may be somewhat described as being thumb shaped so as to be grasped and used as rotational pressure areas for the thumb and center finger of the person installing the spray arm. Lug projections 115 are orientated on flanged portion 42 so that the center of each lug projection 115 is angularly displaced 90° from the center of contact surfaces 110 of ear sections 108.

Washer 72 has an annular forward seating surface 120 and a larger annular rearward seating surface 121 with an edge surface 123 therebetween. The inside diameter of annular seating surfaces 120, 121 are the same and define a washer opening 124. Edge surface 123 has a generally cylindrical section 126 adjacent annular forward seating surface 120 and a frusto-conical surface section 127 adjacent rearward seating surface 121. Frusto-conical surface section 127 forms an acute angle of approximately 41° with rearward seating surface 121 which is sharper than the angle formed by the V-shaped surfaces of frusto-conical bore section 91, i.e. the angle between frusto-conical bore surface 94 and annular washer rearward surface 93. In the preferred embodiment, the washer material is ethylene propylene with a durometer hardness of approximately 50–60. The thickness of the washer is between 0.162 to 0.150 inches and is compressed in the connect position of the connect-/disconnect arrangement to about 0.135 inches.

OPERATION

Washer 72 is initially snapped into frusto-conical bore section 91 of hub member 70 and frusto-conical surface section 127 of washer 72 is effective to retain washer 72 in frusto-conical bore section 91. Spindle 35 is placed into hub portion 79 of hub member 70 so that stem portion 75 passes through washer opening 124 and ear sections 108 lie between tab segments 100. With the configuration of ear sections 108 and tab segments 100 as shown, the operator grasps lug projections 115 by his thumb and middle finger and rotates spindle 35 clockwise whereupon leading end wall 111 of ear sections 108 ramp against contact surfaces 102 of tab segments 100 adjacent tab sections leading end walls 103 forcing spindle forward washer seat surface 95 to axially compress washer 72 as spindle 35 is rotated further within hub member 70. As rotation is continued, contact surfaces 110 of ear sections 108 pass over projections 106 of tab segments 100 until stop end wall 112 of ear sections 108 contacts trailing end wall 104 of tab segments 100. At this position, besides the positive contact between stop end wall 112 of ear section 108 with leading end wall 103 of tab segment 100, projection 106 snaps, by virtue of the compressive force of washer 72, into recess 114. The snapping of projection 106 into recess 114 when the connect position of the connect/disconnect arrangement is reached is similar to that of a detent mechanism and provides positive assurance to the operator that the connect position has been fully reached. As noted above, the dimensioning of ear sections 108 and tab segments 100 and the arcuate orientation of lug projection 115 is such that approximately 90° of rotation is all that is needed to achieve the connect position. To disconnect the arrangement, lug projections 115 are grasped and moved in a counterclockwise direction. This will initially require a larger degree of rotational pressure by the operator to unseat the projection-recess 106, 114 interface and some axial force exerted in the direction of hub member 70 may be required on the part of the operator. This is necessary because the interference fit between projection 106 and recess 114 requires a further compression of washer 72 to assure that the connect/disconnect arrangement does not come unseated during operation of the dishwasher which transmits vibrations and eccentric forces to the stem-hub connection. The disconnect force required by the operator, however, is believed to be less than the force required to overcome the recess-projection interference when the dishwasher is operating, because the presence of the water pressure from water supply line 17 further increases the deformation of washer 72 and this in turn requires a higher compressive force to flatten washer 72 to the axial distance equal to the height of the projection which is required when there is no water pressure exerted on washer 72. The height of projection 106 is about 0.010 inches with a radius of 0.032 inches.

The dimensional relationship between the components is somewhat essential to reliable and repeatedly consistent operation of the connect/disconnect arrangement disclosed. For example, the inside diameter of washer opening 124 is identical and closely controlled to the same diameter as that of the bore in hub stem portion 78, i.e. 0.930 inches. The diameter of stem portion 75 is nominally sized at 0.02 inches less, i.e. 0.910 inches, leaving little space for the washer material to expand within hub bore 86 of hub member 70 during axial compression. In point of fact, the radial space between washer 72 and stem portion 75 and the space existing between frusto-conical bore surface 94 and frusto-conical surface section 127 is the only free space existing for flow of the washer material during compression and that area is somewhat controlled to provide a very effective washer seal and one where the resistance to further axial compression increases at a higher rate when projection-recess surfaces 106, 114 have to pass by one another than that which would exist if washer 72 was simply axially compressed between two surfaces in the conventional sense without any limitation on the radial expansion thereof. This increases the stability of the connect/disconnect arrangement. To be more specific on this particular point, the anti-rotative feature of the invention and, to some extent, the stability of the connect/disconnect arrangement will work, as described, without any considerations restraining the space or area within which washer 72 can expand under compression. However, by limiting the area of washer expansion through the dimensional relationships described herein, the stability of the connect/disconnect arrangement as well as the anti-rotation locking feature is improved or enhanced.

In point of fact, any tendency on the part of spindle 35 to tilt relative to hub member 70 is resisted by two axially spaced surfaces in the connect/disconnect arrangement described. One surface contact is the engagement of contact surfaces 102 and 110. Any unloading of one ear section 108-tab segment 100 contact is resisted by a loading exerted on the opposite ear section 108-tab segment 100 contact. The other axially spaced contact surface is the contact between spindle front washer seat surface 95 and hub washer forward seat surface 90 vis-a-vis washer 72 and to some extent that space between washer 72 and spindle stem portion 75 which may be taken up when washer 72 is compressed. Washer 72 is thus normally active, as a vibration dampener absorbing spray arm vibration transmitted through spindle 35 by contact with spindle forward washer seat surface 95 as well as contact with spindle stem portion 75. Additionally, stem portion 75 is dimensionally sized an axial length to extend within stem portion 78 of hub member 70 a distance of about ⅜ of an inch in a connect position. Should any large sudden eccentric force be developed by either spray arm 27, 28 tending to further compress washer 72 and shift spindle stem portion 75 within hub bore section 88 the force will immediately be counteracted by contact between stem portion 75 and hub bore section 88 in stem portion 78 of hub member 70 before any tendency to unseat ear sections 108 and tab segments 100 occur.

The connect/disconnect arrangement of the present invention has been described with reference to a preferred embodiment. Obviously, modifications and alterations will occur to others upon reading and understanding the specifications and disclosure set forth herein. For example, the washer could be flued, several projection-recess configurations provided, etc. It is my intention to include all such modifications and alterations so far as they come within the scope of the present invention.

It is thus the essence of my invention to provide a hand actuated, connect/disconnect arrangement for applying and removing the spray arm of a dishwasher or like appliance which simultaneously provides a highly effective water seal and a positive lock preventing the arrangement from being disconnected during operation of the appliance.

Having thus described the invention, the following is claimed:

1. A hand actuated spray arm assembly for a dishwasher appliance and the like comprising:

a hub member sealingly secured to the tub of said dishwasher and having a configured bore extending axially therethrough;

a spindle having a blind bore therein for removable insertion into said hub;

means securing said spray arm to said spindle for causing said spray arm to discharge water from water supplied to said spray arm through said spindle and said hub and to rotate relative to said spindle;

a resilient washer within said bore of said hub, said hub having at least one tab extending radially inwardly into said bore; said spindle having at least one ear extending radially outwardly therefrom; said tab and said ear having mating, contact surfaces for contacting one another when the bore of the spindle is inserted into and rotated within the hub whereby said washer is compressed to seal said spindle and said hub member;

anti-rotation means associated with said contact surfaces which act to positively resist any relative movement between said tab and said ear contact surfaces when said dishwasher is in operation while providing a water seal between said hub member and said spindle.

2. The spray arm assembly of claim 1 wherein said spindle has at least one flange spaced from said ear extending radially outwardly therefrom and from which radially extends a thumb shaped lug whereby said spindle may be rotated only by the operator's hands to rotate said contact surfaces into and out of confronting relation with one another for installation and removal, respectively, of said spray arm.

3. The spray arm assembly of claim 2 wherein said lug is spaced approximately 90° away from said ear whereby positive rotation of said contact surfaces into and out of confronting engagement is assured.

4. The spray arm assembly of claim 3 wherein a second ear and tab is provided approximately 180° apart from said first tab and ear and a second lug is provided approximately 180° apart from said first lug.

5. The spray arm assembly of claim 1 wherein said ear has a ramp end surface adjacent one end of said contact surface thereof and a stop end surface adjacent the opposite end of said contact surface;

said anti-rotation means including said contact surface of said tab having a projection formed therein adjacent one end thereof; and a depression in the form of said recess extending from said contact surface of said ear adjacent said stop end surface which, when engaged with said projection in the locked position of said spray arm, requires further compression of said washer before any relative movement of said contact surfaces can occur.

6. The spray arm assembly of claim 5 wherein said stop end surface of said ear extends beyond the elevation of said contact surface of tab and functions as a positive stop preventing further rotation of said spindle relative said hub and ensuring engagement of said anti-rotation means; and said ramp surface is inclined relative to said contact surface of said ear whereby movement of one of said contact surfaces relative the other contact surface is insured.

7. The spray arm assembly of claim 6 wherein said anti-rotation means includes a limited space for said washer to resiliently expand to under compression to increase the stability of said connection.

8. The spray arm assembly of claim 1 wherein said washer has a flat annular forward surface, a larger outside diameter annular rearward surface, and an edge surface therebetween, said edge surface defined by a cylindrical surface adjacent said forward surface and a frusto-conical surface adjacent said rearward surface defining a V-shaped lip;

said bore of said hub member having an annular V-shaped recess formed therein, one leg of said recess extending to a diameter at least equal to the outside diameter of said rearward surface of said washer and having a length extending at least to the opening of the washer and the other leg of said recess extending to a diameter equal to the outside diameter of said forward surface of said washer whereby said washer is firmly maintained within said V-shaped recess to assure application of a consistent biasing force when the operator is connecting or disconnecting said spray arm.

9. The spray arm assembly of claim 8 wherein said taper of said frusto-conical surface of said washer forms an included washer angle with said washer rearward surface which is acute and said angle between the legs of said V-shaped recess is larger than said washer angle to provide a space therebetween when the sprayer arm is unconnected which is filled with washer material when the sprayer arm is assembled whereby the washer seals the connector assembly in a stable manner preventing relative movement between said spindle and said hub member.

10. The spray arm assembly of claim 9 wherein said spindle has at least one flange spaced from said ear extending radially outwardly therefrom and from which radially extends a thumb shaped lug whereby said spindle may be rotated only by the operator's hands to rotate said contact surfaces into and out of confronting relation with one another for installation and removal, respectively, of said spray arm.

11. The spray arm assembly of claim 10 wherein said lug is spaced approximately 90° away from said ear whereby positive rotation of said contact surfaces into and out of confronting engagement is assured.

12. The spray arm assembly of claim 11 wherein a second ear and tab is provided approximately 180° apart from said first tab and ear and a second lug is provided approximately 180° apart from said first lug.

13. The spray arm assembly of claim 11 wherein said ear has a ramp end surface adjacent one end of said contact surface thereof and a stop end surface adjacent the opposite end of said contact surface;

said anti-rotation means including said contact surface of said tab having a projection formed therein adjacent one end thereof; and a depression in the form of said recess extending from said contact surface of said ear adjacent said stop end surface which, when engaged with said projection in the locked position of said spray arm, requires further compression of said washer before any relative movement of said contact surfaces can occur.

14. The spray arm assembly of claim 13 wherein a second ear and tab is provided approximately 180° apart from said first tab and ear and a second lug is provided approximately 180° apart from said first lug.

15. The spray arm assembly of claim 14 wherein said stop end surfaces of said ears extend beyond the elevation of said contact surfaces of tabs and function as positive stops preventing further rotation of said spindle relative said hub and ensuring engagement of said anti-rotation means; and said ramp surfaces are inclined relative to said contact surfaces of said ears whereby movement of said contact surfaces of said ears relative the contact surfaces of said tabs is insured.

16. The spray arm assembly of claim 15 wherein said anti-rotation means includes a limited space for said washer to resiliently expand to under compression to increase the stability of said connection.

17. The spray arm assembly of claim 8 wherein said spindle has at least one flange spaced from said ear extending radially outwardly therefrom and from which radially extends a thumb shaped lug whereby said spindle may be rotated only by the operator's hands to rotate said contact surfaces into and out of confronting relation with one another for installation and removal, respectively, of said spray arm.

18. A hand actuated, quick disconnect arrangement for the spray arm of a dishwasher and like appliance comprising:

a hub member having a configured, generally cylindrical bore axially extending therethrough, said hub member having a stem portion extending outside the tub of said appliance for receiving a water supply line and a hub portion extending within said tub and terminating at a hub end; said bore having a generally cylindrical hub section extending a fixed axial distance from said hub end; a frusto-conical bore section extending axially from said hub section and terminating in an annular hub rearward washer seat surface; and a generally cylindrical stem section extending from said washer seat surface through said stem portion; said hub bore section further having at least one tab segment extending radially about said hub section for a fixed arcuate distance; said tab segment having a radially inwardly disposed generally arcuate edge surface axially extending a fixed distance from said hub end and terminating at an annular contact surface; said annular contact surface extending radially outwardly from tab edge surface to the cylindrical surface of said hub section;

a resilient washer having a forward and a rearward annular seat surface, said rearward seat surface in contact with said hub washer rearward seat surface and said forward surface axially extending into said hub section a predetermined axial distance when said spray arm is unconnected from said hub member;

a spindle for carrying said spray arm at a cap end thereof which extends into said tub and having a generally cylindrical stem portion at its opposite end adapted to fit within said stem section of said bore in said hub member; said spindle having a generally cylindrical spacer portion larger in diameter than said stem portion and extending a fixed axial distance toward said cap end from said stem portion; the intersection of said stem and said spacer portions defined by an annular forward washer contact surface extending radially outwardly from said stem portion; said spindle further having a generally cylindrical flange portion extending from said spacer portion towards said tub end for a fixed axial distance;

said spacer portion of said spindle having at least one ear section extending over a predetermined arcuate segment of said spacer portion; said ear section having a rearward surface co-planar with said washer contact surface and extending radially outwardly therefrom; an edge surface extending from said rearward surface a fixed axial distance towards said cap end and a generally annular forward contact surface extending from said edge surface to the cylindrical surface of said spacer portion;

the axial distance in said hub bore between said forward annular surface of said washer and said contact surface of said tab segment when said spindle is disconnected from said hub less than said axial distance when said spindle is positioned in said hub and rotated by the operator to engage said contact surface of said ear section with said contact surface of said tab segment so that said washer is sealingly compressed to seal said spindle and said hub against water seepage therethrough.

19. The quick disconnect arrangement of claim 18 wherein said contact surface of said ear section has a leading end surface at one end and a stop surface at its opposite end and a depression is formed in said ear section's contact surface adjacent said stop end; said contact surface of said tab segment has a leading end surface at one end thereof and a stop surface at its opposite end, said contact surface having a projection adjacent said leading end surface shaped to conform to said depression whereby rotation of said spindle to said connected position causes said projection to mate with said depression and lock said spray arm into a connected position by virtue of compressions of said washer which compression simultaneously forms a water seal between said hub and said spindle.

20. The quick disconnect arrangement of claim 19 wherein said leading end surface of said ear section is angularly disposed relative to said ear section's contact surface to insure the start of rotation of said ear section's contact surface relative to said tab segment's contact surface; said ear section's stop surface axially extends towards said spindle's cap end and beyond said ear section's contact surface to engage said leading end surface of said tab segment to positively prevent rotation of said spindle beyond the connected position; and said depression comprising a groove having a circular cross-section extending across said contact surface from said edge section to said cylindrical surface of said spacer portion of said spindle and said projection comprising a dimple having a similar circular cross-section extending across said face section of said tab segment.

21. The quick disconnect arrangement of claim 20 wherein said forward annular seat surface has an outside diameter, said rearward annular seat surface of said washer having a larger outside diameter than said outside diameter of said forward annular seat surface, said forward and rearward annular seat surfaces having a common inside diameter forming an opening therein; said washer having an edge surface between said forward and said rearward annular surfaces; said edge surface defined by a cylindrical surface adjacent said forward annular surface and a frusto-conical surface adjacent said rearward annular surface, said frusto-conical surface forming an included acute angle with said rearward annular surface;

said frusto-conical section of said hub's bore including a frusto-conical wall surface forming an acute angle with said annular hub washer seat surface which is larger than said acute angle of said washer whereby said washer is distended into the space formed therebetween when said spindle is connected to said hub member form a stable hub-spindle joint which dampens vibration from said spray arm.

22. The quick disconnect arrangement of claim 21 wherein said flange portion of said spindle has at least one lug extension extending radially outwardly from the cylindrical surface of said flange portion, said lug extension angularly displaced from said ear section approximately 90° whereby the operator's fingers easily engage said flange section for rotating said spindle into and out of a connected position.

23. The quick disconnect arrangement of claim 22 wherein a second tab section, ear section and a lug section are provided, each section angularly displaced approximately 180° relative to its corresponding section; and said contact surfaces of said ear sections and said tab sections circumscribe an angular arc of about 60° to provide a direct contact force on said washer extending at least about 120° while permitting a total rotational movement of said spindle from a disconnect to a connect position of no more than about 90°.

24. The quick disconnect arrangement of claim 23 wherein a spray arm hub assembly is provided for removably mounting said spray arm to said spindle, said assembly including;

a spray hub member from which extends at least a pair of diametrically opposed, longitudinally extending spray arms;

said spindle having cross ports adjacent its cap end providing fluid transmission with a central bore extending through said spindle's stem end section which is in fluid communication with said hub member's bore;

bearing means adjacent said cap end of said spindle and said spray hub member and said flange portion of said spindle and said spray hub member permitting free rotation of said spray hub relative to said spindle, and sealing means between said spray hub member and said spindle providing fluid communication from said cross ports to said spray arms while preventing water leakage between said spindle and said spray hub member.

* * * * *